US006371472B1

(12) United States Patent
Miyake et al.

(10) Patent No.: US 6,371,472 B1
(45) Date of Patent: Apr. 16, 2002

(54) SHEET PROCESSING FOR STACKING SHIFTED SHEET BUNDLES

(75) Inventors: Norifumi Miyake, Kashiwa; Chikara Sato, Hachiouji; Yasuo Fukazu; Mitsushige Murata, both of Abiko; Masatoshi Yaginuma, Toride; Kiyoshi Okamoto, Toride; Tsuyoshi Moriyama, Toride, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,373

(22) Filed: Dec. 1, 1999

(30) Foreign Application Priority Data

Dec. 15, 1998 (JP) ..... 10-375296

(51) Int. Cl.[7] ..... B65H 57/00

(52) U.S. Cl. ..... 270/58.14; 270/58.08; 414/791.2; 414/789

(58) Field of Search ..... 271/221; 414/789, 414/791.2; 270/52.18, 58.07, 58.08, 58.14

(56) References Cited

U.S. PATENT DOCUMENTS 4,073,391 A * 2/1978 O'Brien et al. ..... 414/789
5,390,016 A 2/1995 Hoshi et al. ..... 355/308
5,398,918 A * 3/1995 Rizzolo et al. ..... 270/58.08
5,455,667 A 10/1995 Hiroi et al. ..... 355/309
5,513,839 A * 5/1996 Green ..... 270/58.07
5,580,039 A 12/1996 Takehara et al. ..... 270/58.11
5,761,600 A 6/1998 Murata ..... 399/403
5,772,198 A * 6/1998 Yamamoto ..... 270/58.12
5,909,871 A * 6/1999 Takehara ..... 270/58.07
6,021,305 A 2/2000 Sato et al. ..... 399/374

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

Sheet processing apparatus including a process tray for stacking sheets received from an image forming apparatus, a jogger for jogging the sheet stacked on the process tray at one of two jogging positions, a discharge unit for discharging the sheet stacked on the process tray, and a discharge tray for stacking the sheets discharged by the discharge unit. The sheet processing apparatus includes a stapler for stapling the sheets stacked on the process tray, and a controller for controlling the stapler to staple the sheets at a stapling position corresponding to the jogging position by the jogger.

36 Claims, 16 Drawing Sheets

DISCHARGE DIRECTION
DISCHARGE DIRECTION
640a
S1
601
A1
A2
S2
640b
BUNDLE OF SHEETS
CENTER
JOGGING POSITION A
640a
S1
601
B1
B2
S2
640b
BUNDLE OF SHEETS
JOGGING POSITION B
A1
B1
B2
A2
a
b
c
d
POSITION OF STAPLER

SHEET PROCESSING FOR STACKING SHIFTED SHEET BUNDLES

BACKGROUND OF THE INVENTION

1. Field of the Invention

The present invention relates to sheet processing for stacking bundles of sheets which are shifted with respect to each other on a discharge tray.

2. Description of the Related Art

Conventional sheet processing apparatuses sort sheets or staples sheets. The sheet processing apparatus receives sheets from a copier or a printer one by one and stacks the sheets on a process tray. The sheet processing apparatus jogs the sheets on the process tray and staples the sheets on the process tray. Then, the sheet processing apparatus discharges the stapled sheets onto a discharge tray in a bundle. The sheet processing apparatus shifts the discharge tray after each discharge of a stapled bundle of sheets in order to shift the bundles of the sheets with respect to each other. That is, a bundle of sheets on the discharge tray are shifted with respect to each other, therefore, it is easy to separate the bundle of sheets from other bundles. When the stapled sheets are shifted on the discharge tray, the positions of the staples are deconcentrated, thereby preventing an unbalanced stack.

However, the stack of bundled sheets on the discharge tray becomes unstable because of the discharge tray moving. Furthermore, an extra wall for supporting the sheets on the discharge tray and a powerful motor for moving the discharge tray are needed in order to stack a large number of sheets. Therefore, a large number of sheets can not be stacked on the discharge tray without the extra wall and powerful motor being provided. But, the extra wall and powerful motor rise the manufacturer's cost of the sheet processing apparatus. Furthermore, the powerful motor makes the sheet processing apparatus large.

SUMMARY OF THE INVENTION

An object of the present invention is to provide sheet processing for stacking sheets in a state the bundles of sheets are shifted with respect to each other on a discharge tray without moving the discharge tray.

In order to achieve the above object, the present invention provides sheet processing apparatus comprising a first tray for stacking sheets received from an image forming apparatus, a jogger for jogging the sheet stacked on said first tray at one of a plurality of jogging positions, a discharger for discharging the sheet stacked on said first tray, and a second tray for stacking the sheets discharged by said discharger.

Other objects and features of the invention will be apparent from the following description and the drawings.

DESCRIPTION OF THE PREFERRED EMBODIMENTS

Figure 1:
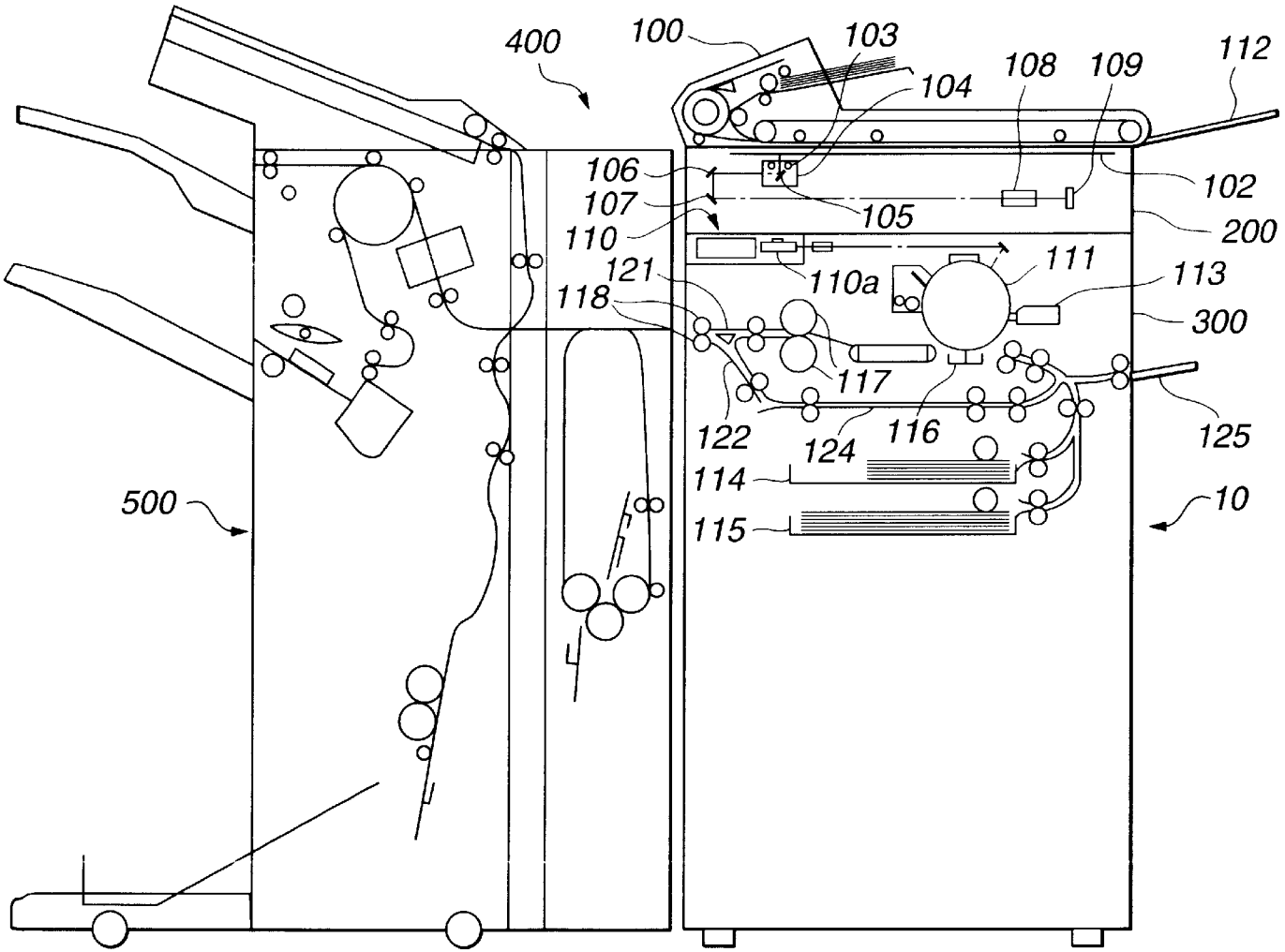
FIG. 1 shows an image forming apparatus.

FIG. 1 shows image forming apparatus 10, folding apparatus 400, and sheet processing apparatus 500. Image forming apparatus 10 includes reader 200 and printer 300.

Document feeder 100 is provided to reader 200. Document feeder 100 feeds counterclockwise one by one documents set on a document tray to discharge tray 112 through plate glass 102 along paths. Meanwhile, the documents are set on the document tray in a face-up state by a user and fed in a page order. While the document go through plate glass 102, the document is scanned by scanner unit 104 held at a reading position on plate glass 102. This scanning manner is referred to as a moving-document-scanning. Specifically, when the document go through the reading position, the document is illuminated by lamp 103 of scanner unit 104 and the reflected light from the document is led to lens 108 through mirror 105, 106, and 107. The light going through lens 108 is read by image sensor 109.

In this manner, the document is read at right angles to the document feeding direction which is known as a main scanning direction and the document feeding direction is known as a sub scanning direction. That is, when the document go through the reading position, the image on the main scanning direction is read by image sensor 109 and the whole image of the document is read by the scanning by the main scanning direction being performed line by line. Image sensor 109 outputs image data in accordance with the document image. Image signal control unit 202 processes image data from image sensor 109, which will be described later, and outputs the processed image data to exposure control unit 110 as a video signal.

On the other hand, it is possible that the document is read by moving scanner unit 104 from the left hand to the right hand in a document stationary state after document feeder 100 feeds the document to plate glass 102. This scanning manner is referred to as a stationary document scanning.

When the document is read without using document feeder 100, that is, when the user sets the document on plate glass 102 one by one, the stationary document scanning is used.

Exposure control unit 110 emits a laser beam in accordance with the image data. The laser beam is scanned by polygon mirror 110*a* and led to photosensitive drum 111. An electrostatic latent image is formed on photosensitive drum 111 in accordance with the laser beam.

The electrostatic latent image is visualized by developing unit 113 as a toner image. Meanwhile, a sheet is fed from one of cassette 114, 115, manual feed unit 125, and re-feed path 124 in sync with the time the laser beam is emitted. The sheet is fed to transfer unit 116. Transfer unit 116 transfers the toner image on photosensitive drum 111 onto the sheet.

The sheet having the transferred toner image is transported to fixing unit 117. Fixing unit 117 fixes the toner image onto the sheet by heat and pressure. The fixed sheet is discharged out of image forming apparatus 10 through flapper 121 and discharge roller 118.

In case where the sheet is discharged in a face-down state in which the toner image faces downward, the fixed sheet is led to re-feed path 122 by flapper 121 temporarily and is transported in an opposite direction after the trailing edge of the sheet goes through flapper 121. Then the sheet is discharged out of image forming apparatus 10 by discharge roller 118. This discharge manner is referred to as an inversion discharge. When image data is formed from the first page in a page order such as when document feeder 100 is used and when the image data is generated by a computer, the inversion discharge is done in order to output the sheets in the correct page order.

When sheets are fed from manual feeding unit 125, the inversion discharge is not done, because a hard sheet such as an OHP sheet may be set on manual feeding unit 125.

Figure 2A:
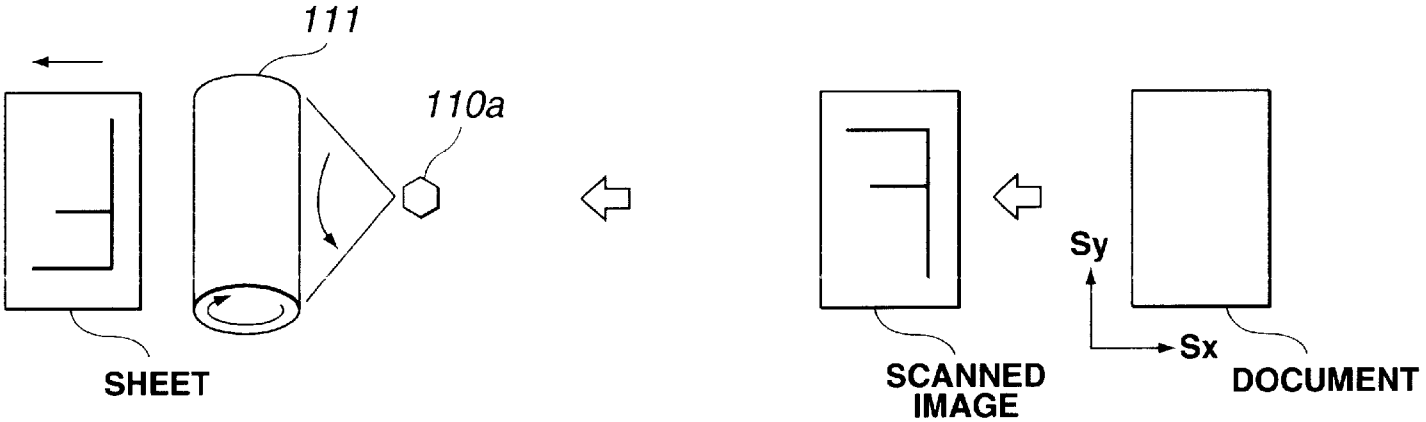
FIG. 2 shows an image formation process.
Figure 2B:
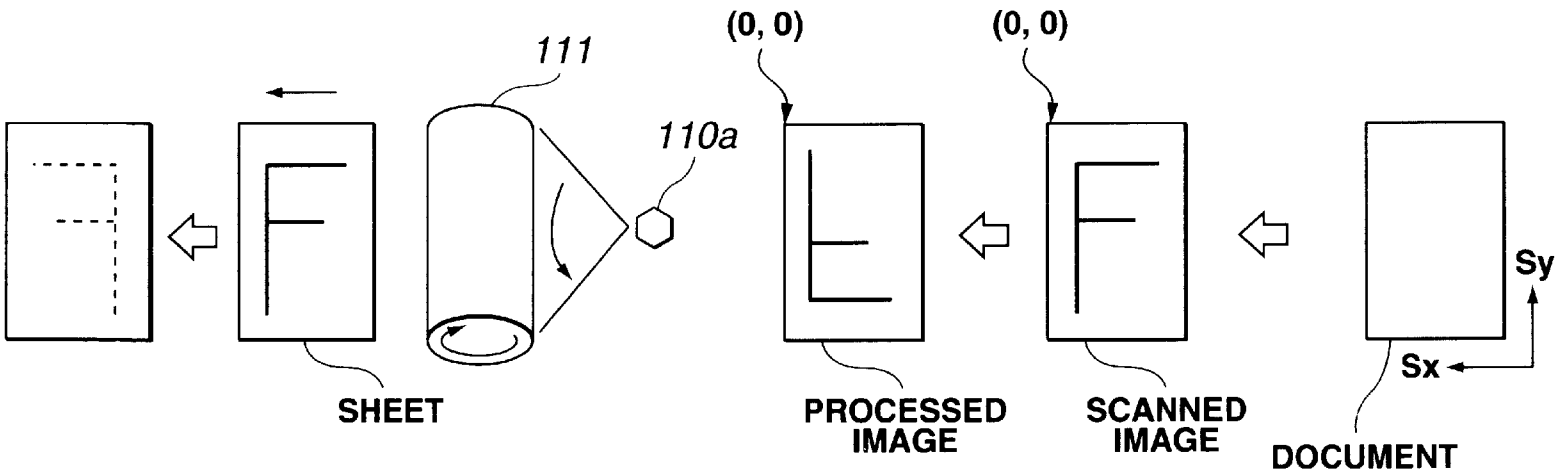

The image formation in the moving document scanning and stationary document scanning will be described hereinafter with reference to FIG. 2. When the stationary document scanning is done, a document is scanned by moving scanner unit 104 from the left hand to the right hand. That is, the document is scanned by image sensor 109 as shown in FIG. 2(*a*) in which Sy is the main scanning direction and Sx is the sub scanning direction. Exposure control unit 110 emits a laser beam according to the scanned image. The laser beam is scanned to photosensitive drum 111 by polygon mirror 110*a*. Then, a right (not mirror) image is formed on a sheet.

On the other hand, when the moving document scanning is done, a document is scanned by moving the document from the left hand to the right hand. That is, the document is scanned by image sensor 109 as shown in FIG. 2(*b*) in which Sy is the main scanning direction and Sx is the sub scanning direction. The sub scanning direction of the moving document scanning is opposite to the one of the stationary document scanning. Therefore, the scanned image becomes a mirror image.

To correct the mirror image, a mirror processing is done to the image scanned by image sensor 109 when the moving document scanning is done. The mirror processing inverts the image data on the main scanning direction Sy. Thereby, the mirror image is corrected and the corrected image is formed on a sheet. The sheet is inverted and is discharged by the inversion discharge. Then, the trailing edge of the sheet is stapled by sheet processing apparatus 500. Thereby, the left edge of the image on the sheet is stapled.

The mirror processing can be done by inverting the image data on the sub scanning direction Sx. However, in case where the mirror processing is done by inverting the image data on the sub scanning direction Sx, the mirror processing can not be started until the whole page of the document is scanned. Furthermore, when the inversion discharge must be done, sheet processing apparatus 500, which only can staple the trailing edge of the sheet, can not staple the left of the image on the sheet. Therefore, inverting the image data on the main scanning direction Sy is preferable.

The sheet discharged from printer 300 is transferred to sheet folding apparatus 400. When the size of the sheet is A3 or B4, sheet folding apparatus folds the sheet in a Z-shape and transports the folded sheet to sheet processing apparatus 500. When the size of the sheet is not A3 or B4, sheet folding apparatus does not fold the sheet and transports the sheet to sheet processing apparatus 500. Sheet processing apparatus 500 does a stapling process, a punching process, and so on.

Figure 3:
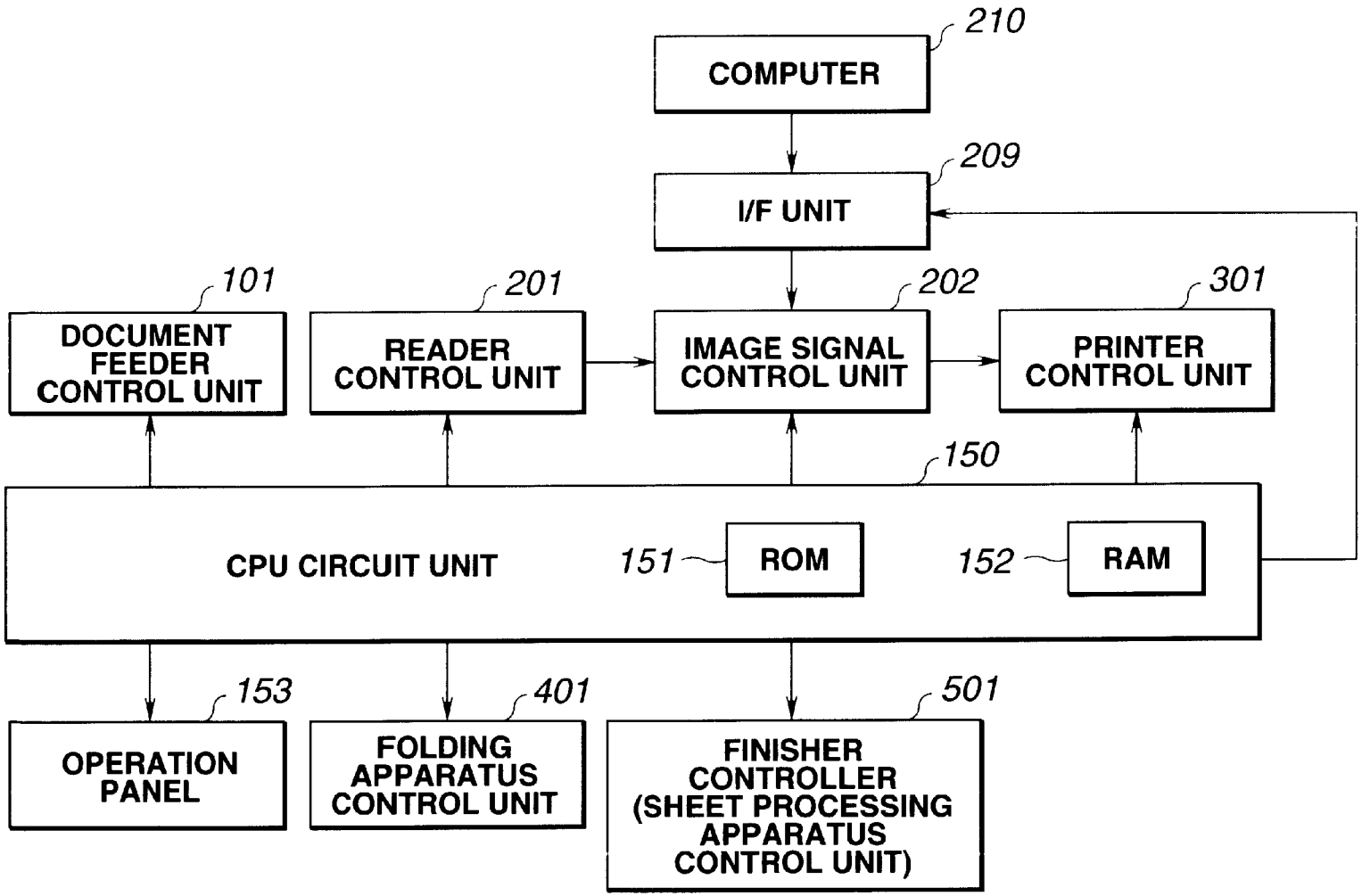
FIG. 3 shows a block diagram of a controller in the image forming apparatus.

A controller, which controls image forming apparatus 10, will be described with reference to FIG. 3. FIG. 3 shows a block diagram of the controller.

The controller includes CPU circuit unit 150. CPU circuit unit 150 includes a CPU (not shown), ROM 151, and RAM 152. CPU circuit unit 150 controls blocks 101, 153, 201, 202, 203, 209, 301, 401, 501 in accordance with a program stored in ROM 151 or RAM 152. For example, the program can be stored in a memory medium such as CD-ROM and floppy disc and can be read from the memory medium and can be stored in RAM 152 and can be executed by CPU circuit unit 150. RAM 152 stores control data temporarily.

Document feeder control unit 101 controls document feeder 100. Reader control unit 201 controls various functions in image forming apparatus 10 such as scanner unit 104, document feeder 100, image sensor 109. Image signal output from image sensor 109 is transferred to image signal control unit 202.

Image signal control unit 202 converts the image signal from image sensor 109 into digital signal and does some processes to the digital signal. Image signal control unit 202 converts the digital signal into a video signal and outputs the video signal to printer control unit 301. Printer control unit 301 drives exposure control unit 110. Operation panel 153 includes both keypads for designating various functions regarding an image formation and a display for displaying a designation of the functions. Operation panel 153 outputs a keypad signal corresponding to the keypad to CPU circuit unit 150 and displays information corresponding to a signal from CPU circuit unit 150.

Folding apparatus control unit 401 is provided in folding apparatus 400 and controls folding apparatus 400. Sheet processing apparatus control unit 501 is provided in sheet processing apparatus 500 and control sheet processing apparatus 500.

Figure 4:
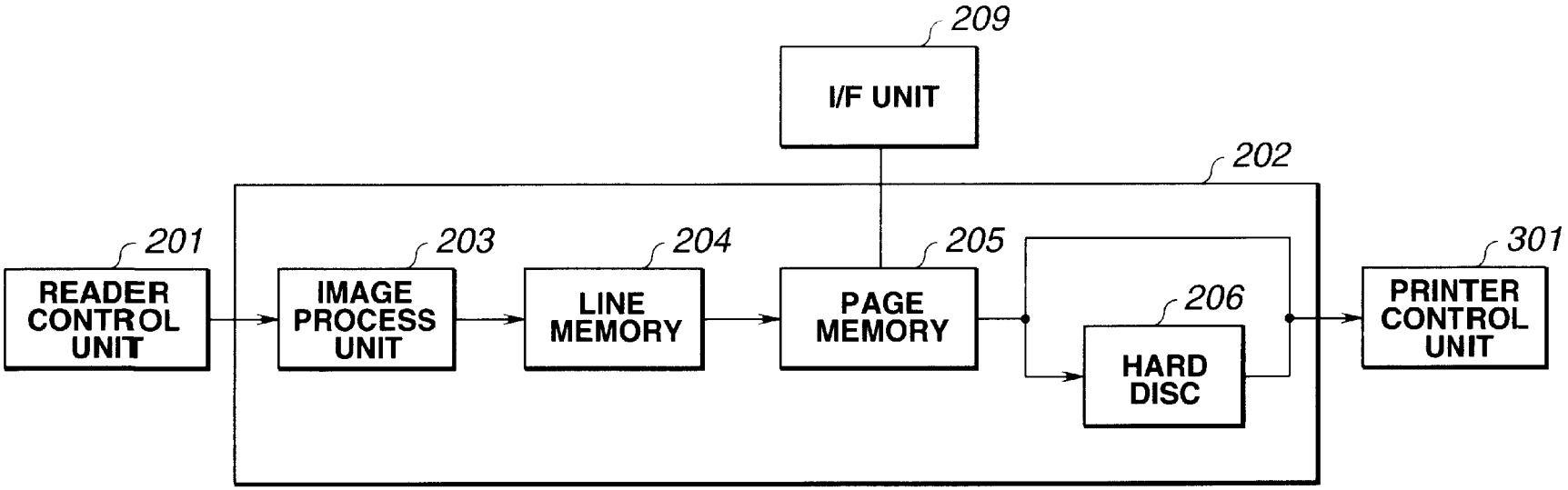
FIG. 4 shows a block diagram of an image signal control unit.

FIG. 4 shows a block diagram of image signal control unit 202. Image process unit 203 converts an image signal from reader control unit 201 into a digital signal and does various processes to the digital image. The processes includes a shading compensation, an edit process according to a designation of operation panel 153, and a density compensation. The processed image data is transferred to line memory 204.

Line memory 204 is for achieving the above described mirror processing. The image data on the main scanning direction is stored in line memory 204 and is read from line memory 204 in an opposite direction to the storing direction. The image data read from line memory 204 is stored in page memory 204. Page memory 205 stores at least one document image. Page memory 205 stores image data received from computer 210 through I/F unit 209.

Image data stored in page memory 204 is transferred to printer control unit 301 directly or through hard disc 206. For example, hard disc 206 is used when a page order of image data is changed.

Figure 5:
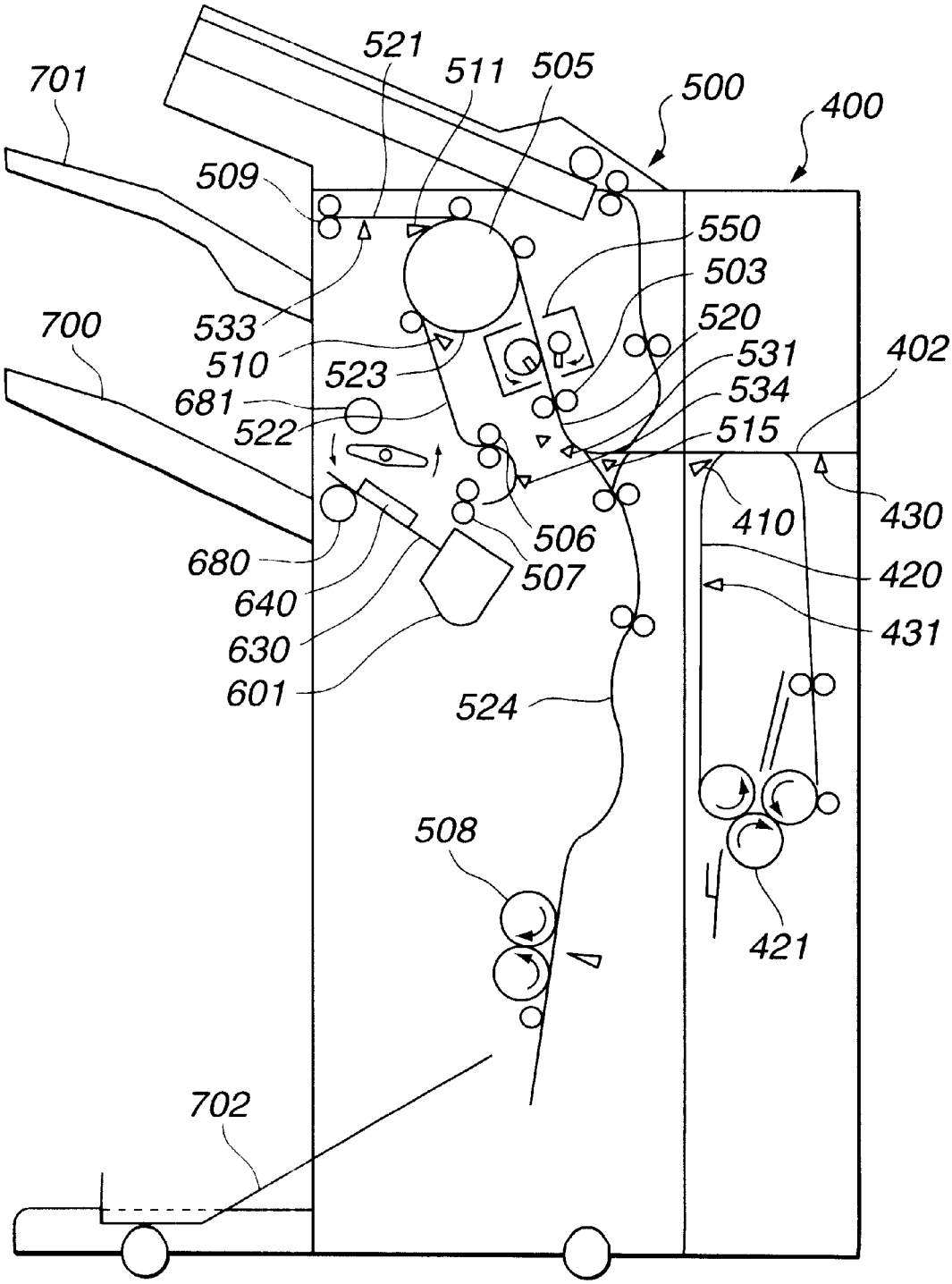
FIG. 5 shows a sheet processing apparatus.

Sheet folding apparatus 400 and sheet processing apparatus 500 will be described hereinafter with reference to FIG. 5. Path 402 receives a sheet from printer 300 and leads the sheet to sheet processing apparatus 500. Sensor 430 is provided on path 402 and detects the sheet received from printer 300. Flapper 410 is provided on path 402 and leads the sheet to either sheet processing apparatus 500 or path 420.

When the sheet is folded, flapper 410 leads the sheet to path 420. The sheet is folded in a Z shape by rollers 421. Sensor 431 detects the jam of the sheet. When the sheet is not folded, flapper 410 leads the sheet to sheet processing apparatus 500.

Sheet processing apparatus 500 receives the sheet from sheet folding apparatus 400. Sheet processing apparatus 500 jogs the sheets and staples the edge of the sheets. Sheet processing apparatus 500 also punches the sheet. Sheet processing apparatus 500 also makes a booklet by stapling the center of the sheets and folding the center of the sheets.

Flapper 515 leads the sheet to either path 524 or path 520. The sheets led to path 524 are stapled at the center thereof and are folded at the center thereof by roller 508. The folded sheets are discharged to discharge tray 702.

The sheet led to path 520 is transported to punch unit 550. Punch unit 550 includes punches and dies as shown in FIG. 5. The punches and dies are rotated by a motor and punches the sheet being transported. The rotation speed of the punches and dies is equal to the transportation speed of the sheet. The rotation of the punches and dies are started upon sensor 531 sensing the sheet, thereby, punch unit 550 punches the sheet. When the punch is not designated, the punches and dies stay without interfering the sheet transported along path 520. Therefore, the sheet goes through punch unit 550 without being punched.

The sheet going through punch unit 550 is transferred to roller 505. Plural sheets can be wound around roller 505 by blocking paths 511 and 522 by flappers 511 and 510. The sheet is led to path 521 by flapper 511 and is led to path 522 by flapper 510.

The sheet led to path 521 is discharged to discharge tray 701 by roller 509. Sensor 533 is provided on path 521. Discharge tray 701 is moved vertically.

The sheet wound around roller 511 is led to path 522 by flapper 510. The sheet is transferred to process tray 630 through roller 506 and 507. Sensor 534 is provided on path 522 between roller 506 and 507.

The sheet transported by roller 507 is stacked on process tray 630 and then jogged by jogger 640. The sheets stacked on process tray 630 are stapled by stapler 601. Another binder can be provided if stapling is not desired. The sheets are discharged to discharge tray 700 in a stapled bundle by roller 680 (this is referred as a bundle discharge) after the sheets are jogged and stapled. Discharge tray 700 is moved vertically.

Figure 6:
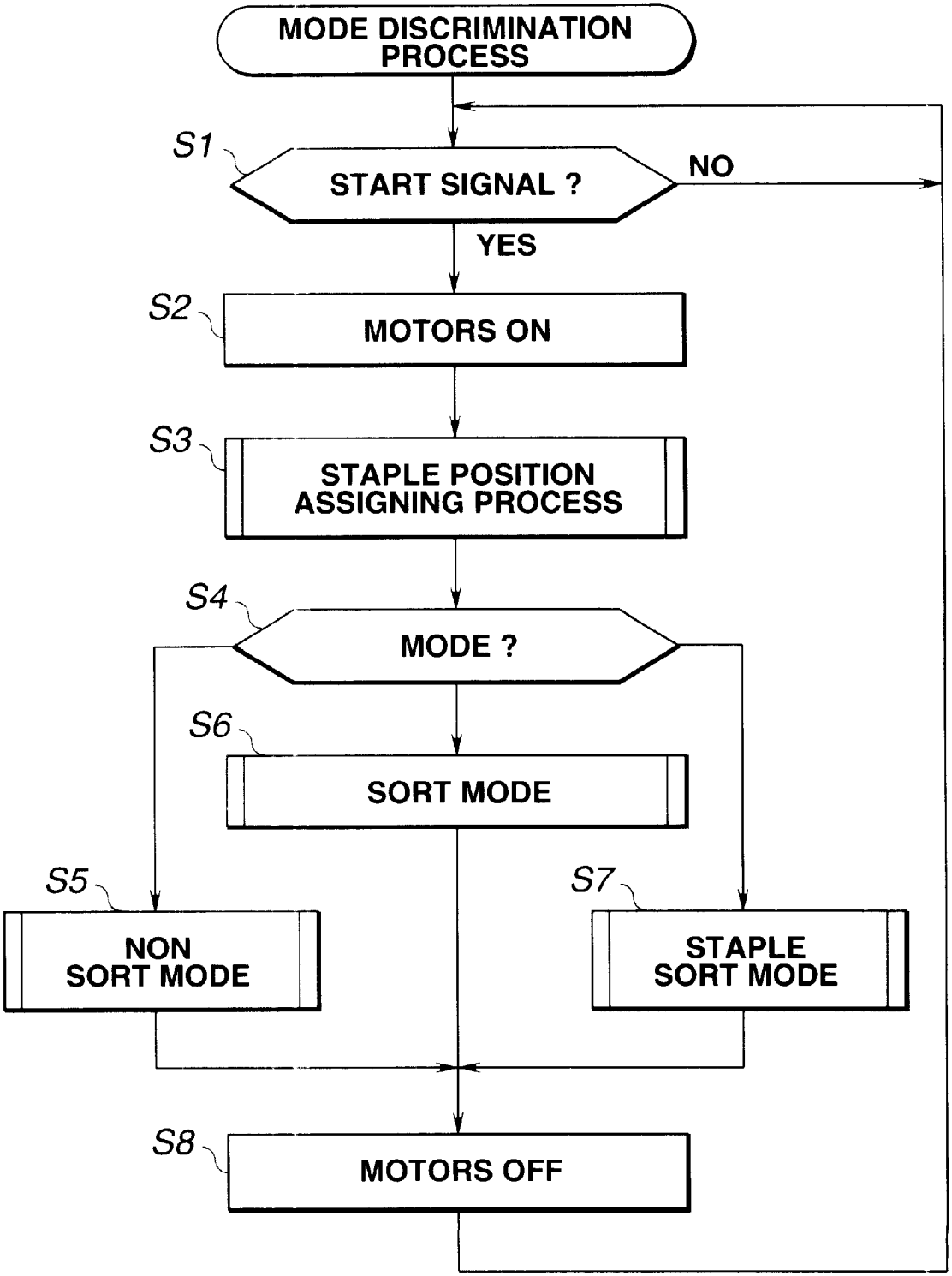
FIG. 6 shows a flowchart for discriminating a mode regarding the sheet processing apparatus.

A movement of sheet processing apparatus 500 will be described hereinafter with reference to FIGS. 6 to 16. Sheet processing apparatus control unit (finisher controller) 501 controls the movement of sheet processing apparatus 500 in accordance with CPU circuit unit 150. CPU circuit unit 150 controls finisher controller 501 in accordance with the program stored in ROM 151 or RAM 152. FIG. 6 shows a flowchart for discriminating a mode regarding sheet processing apparatus 500. Finisher controller 501 discriminates if a start signal for starting the movement of sheet processing apparatus 500 is generated by CPU circuit unit 150 (S1). CPU circuit unit 150 generates the start signal upon a start key being pressed on operation panel 153. Step S1 is repeated until the start signal is generated.

If the start signal is generated at step S1, finisher controller 501 turns on motors driving rollers in sheet processing apparatus 500 (S2). Finisher controller 501 does a staple position assigning process (S3). The staple position assigning process will be described later with reference to FIG. 14.

Then, finisher controller 501 discriminates a mode designated by operation panel 153 (S4). If a non sort mode is designated, finisher controller 501 advances to step S5. If a sort mode is designated, finisher controller 501 advances to step S6. If a staple sort mode is designated, finisher controller 501 advances to step S7. After processing one of step S5, S6, and S7, finisher controller 501 turns off the motors driving rollers in sheet processing apparatus 500 (S8) and returns to step S1.

Figure 7:
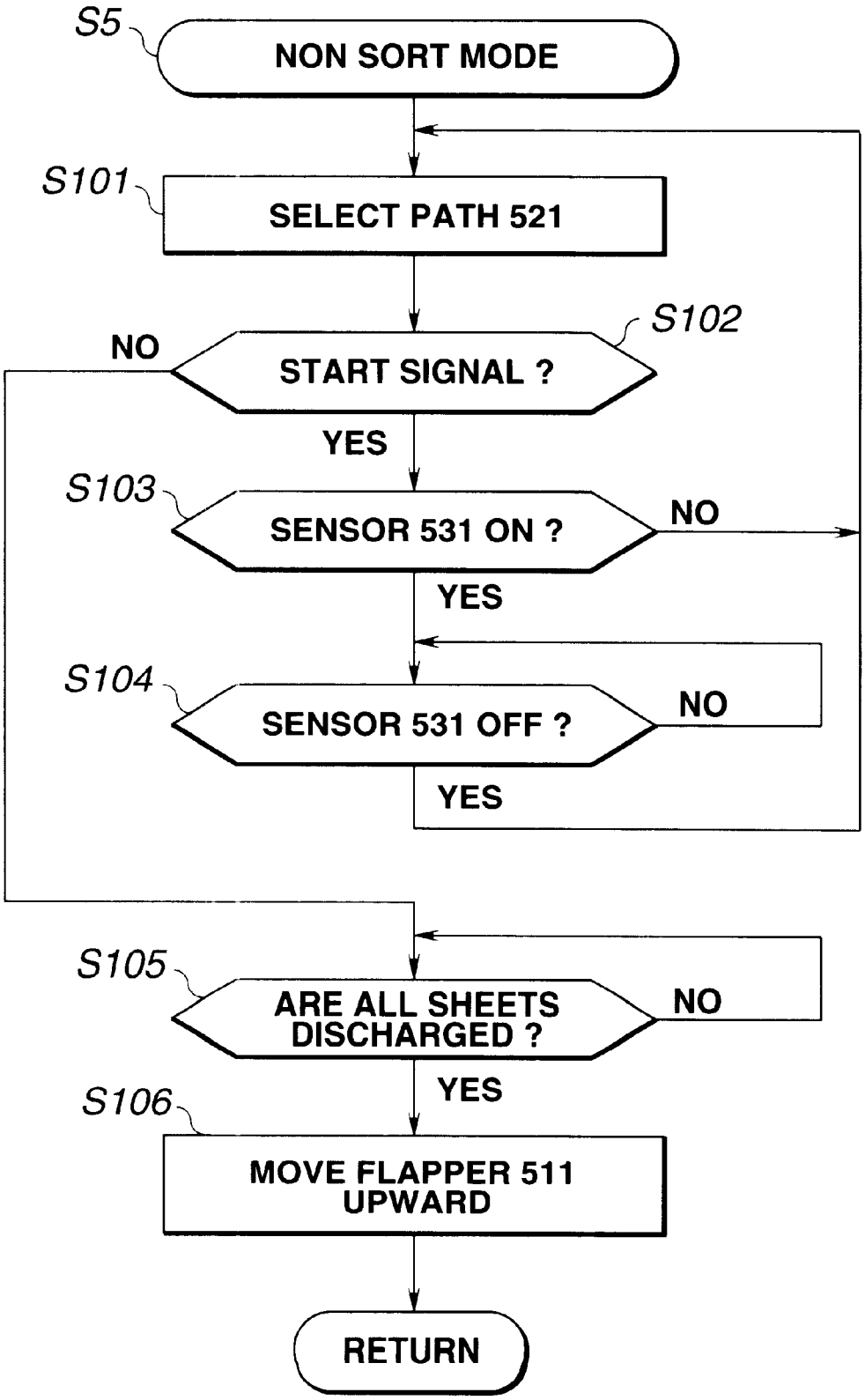
FIG. 7 shows a flowchart for a non-sort process in FIG. 6.

FIG. 7 shows a flowchart for a non sort process at step S5. Finisher controller 501 controls flapper 511 to move downward in order to select path 521 (S101). Meanwhile, finisher controller 501 controls flapper 515 to select path 520. Finisher controller 501 discriminates if the start signal is generated (S102). If the start signal is generated, finisher controller 501 discriminates if sensor 531 detects the sheet received from sheet folding apparatus 400 (S103). If sensor 531 does not detect the sheet, finisher controller 501 returns to step S101. If sensor 531 detects the sheet, finisher controller 501 discriminates if the detection result of sensor 531 changes to OFF (S104). If the detection result of sensor 531 is still ON, finisher controller 501 repeats step S104. If the detection result of sensor 531 changes to OFF, finisher controller 501 returns to step S101.

If the start signal changes to OFF at step S102, since this means that the image formation in printer 300 is finished, finisher controller 501 advances to step S105. Finisher controller 501 discriminates if all sheets are discharged to discharge tray 701 in accordance with the detection result of sensor 533 (S105). Finisher controller 501 repeats step S105 until sensor 533 detects the trailing edge of the last sheet. If all sheets are discharged to discharge tray 701, finisher controller 501 controls flapper 511 to move upward (S106) and returns to FIG. 6.

Figure 8:
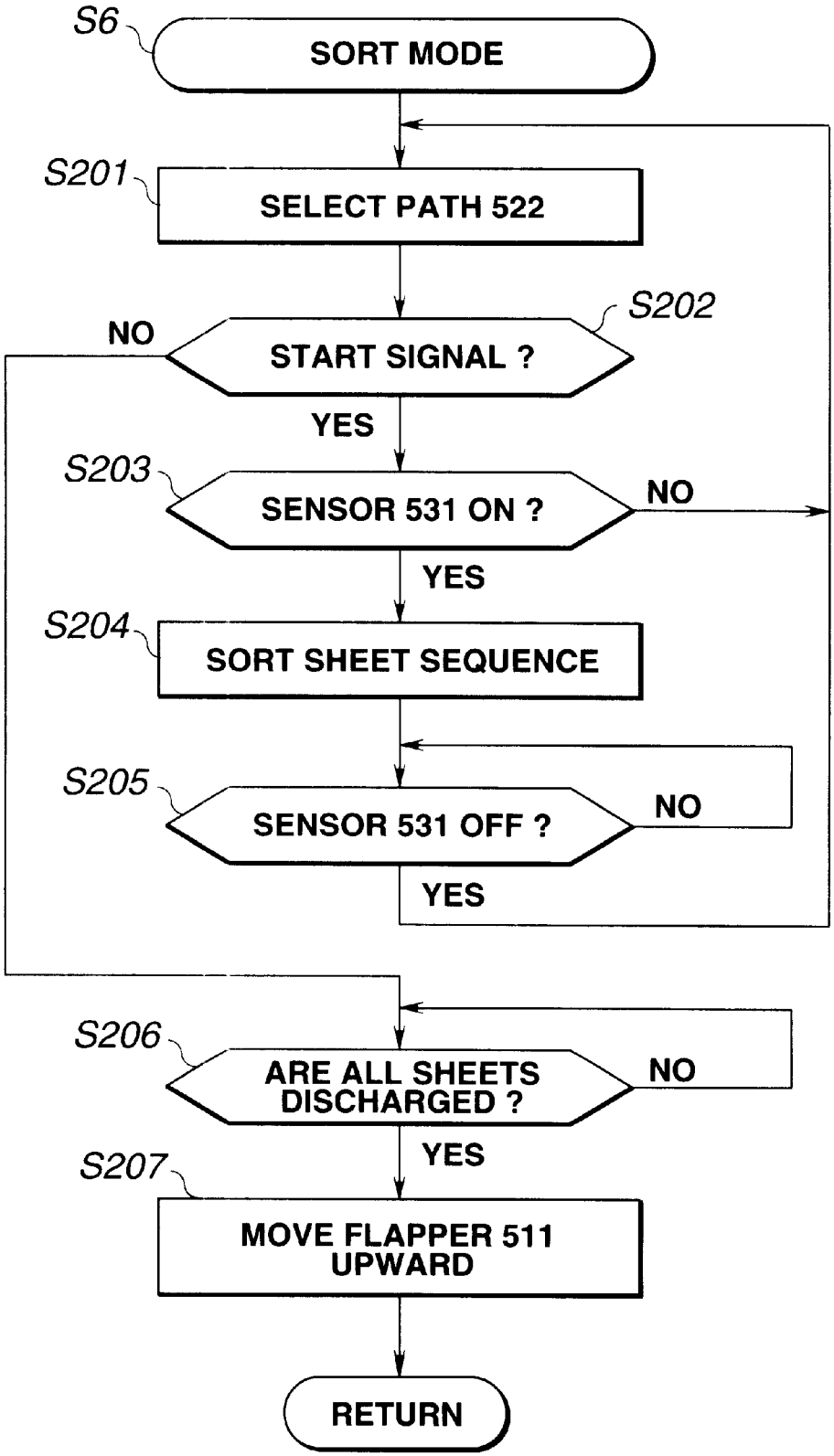
FIG. 8 shows a flowchart for a sort process in FIG. 6.

FIG. 8 shows a flowchart for a sort process at step S6. Finisher controller 501 controls flapper 511 to move upward in order to select path 522 (S201). Meanwhile, finisher controller 501 controls flapper 515 to select path 520. Finisher controller 501 discriminates if the start signal is generated (S202). If the start signal is generated, finisher controller 501 discriminates if sensor 531 detects the sheet received from sheet folding apparatus 400 (S203). If sensor 531 does not detect the sheet, finisher controller 501 returns to step S201. If sensor 531 detects the sheet, finisher controller 501 executes a sort sheet sequence (S204). The sort sheet sequence will be described later. Then, finisher controller 501 discriminates if the detection result of sensor 531 changes to OFF (S205). If the detection result of sensor 531 is still ON, finisher controller 501 repeats step S205. If the detection result of sensor 531 changes to OFF, finisher controller 501 returns to step S201.

If the start signal changes to OFF at step S202, since this means that the image formation in printer 300 is finished, finisher controller 501 advances to step S206. Finisher controller 501 discriminates if all sheets are discharged to discharge tray 701 in accordance with the detection result of sensor 533 (S206). Finisher controller 501 repeats step S206 until sensor 533 detects the trailing edge of the last sheet. If all sheets are discharged to discharge tray 701, finisher controller 501 controls flapper 511 to move upward (S207) and returns to FIG. 6.

Figure 9:
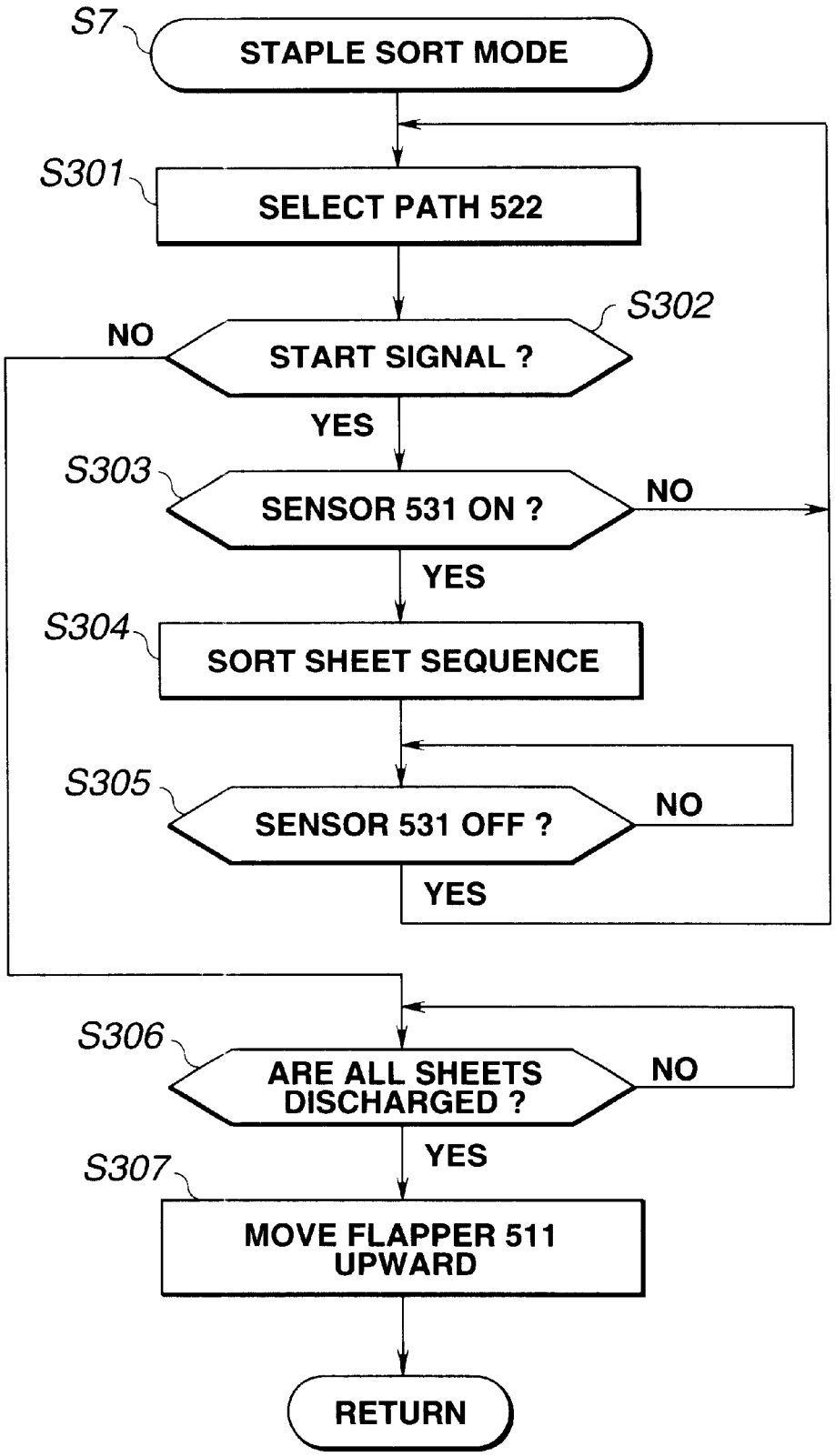
FIG. 9 shows a flowchart for a staple/sort process in FIG. 6.

FIG. 9 shows a flowchart for a staple sort process at step S7. Finisher controller 501 controls flapper 511 to move upward in order to select path 522 (S301). Meanwhile, finisher controller 501 discriminates controls flapper 515 to select path 520. Finisher controller 501 discriminates if the start signal is generated (S302). If the start signal is generated, finisher controller 501 discriminates if sensor 531 detects the sheet received from sheet folding apparatus 400 (S303). If sensor 531 does not detect the sheet, finisher controller 501 returns to step S301. If sensor 531 detects the sheet, finisher controller 501 executes the sort sheet sequence (S304). Then, finisher controller 501 discriminates if the detection result of sensor 531 changes to OFF (S305). If the detection result of sensor 531 is still ON, finisher controller 501 repeats step S305. If the detection result of sensor 531 changes to OFF, finisher controller 501 returns to step S301.

If the start signal changes to OFF at step S302, since this means that the image formation in printer 300 is finished, finisher controller 501 advances to step S306. Finisher controller 501 discriminates if all sheets are discharged to discharge tray 701 in accordance with the detection result of sensor 533 (S306). Finisher controller 501 repeats step S306 until sensor 533 detects the trailing edge of the last sheet. If all sheets are discharged to discharge tray 701, finisher controller 501 controls flapper 511 to move upward (S307) and returns to FIG. 6.

Figure 10:
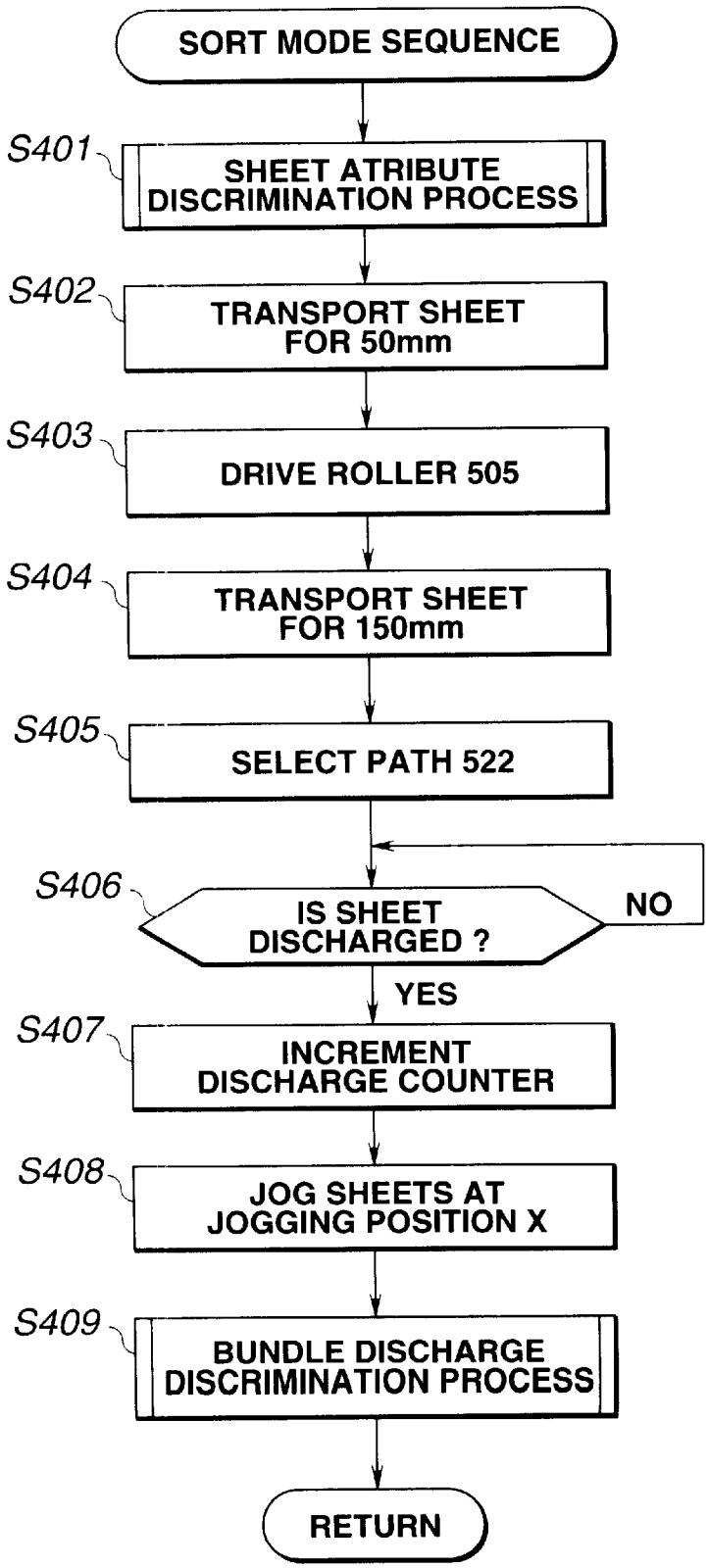
FIG. 10 shows a flowchart of the sort sheet sequence in FIGS. 8 and 9.

FIG. 10 shows a flowchart of the sort sheet sequence at steps S204 and S304. The sort sheet sequence is assigned to each sheet and is executed in parallel with other sequences. This is called a multi task.

Finisher controller 501 executes a sheet attribute discrimination process (S401). The sheet attribute discrimination process will be described later. Then, finisher controller 501 controls the transport of the sheet for 50 mm (S402) and controls drive roller 505 (S403).

Finisher controller 501 controls to transports the sheet for 150 mm (S404) and controls flapper 510 to select path 522 (S405). The sheet is led to process tray 630 through path 522. Finisher controller 501 discriminates if the sheet is discharged to process tray 630 (S406). If the sheet is not discharged yet, finisher controller 501 repeats step S406. If the sheet is discharged, finisher controller 501 increments a discharge counter (S407). Finisher controller 501 controls jogger 640 to jog the sheet discharged on process tray 630 at a jogging position X (S408) and executes a bundle discharge discrimination process (S409) and returns to the flowchart shown in either FIG. 8 or 9.

Figure 11:
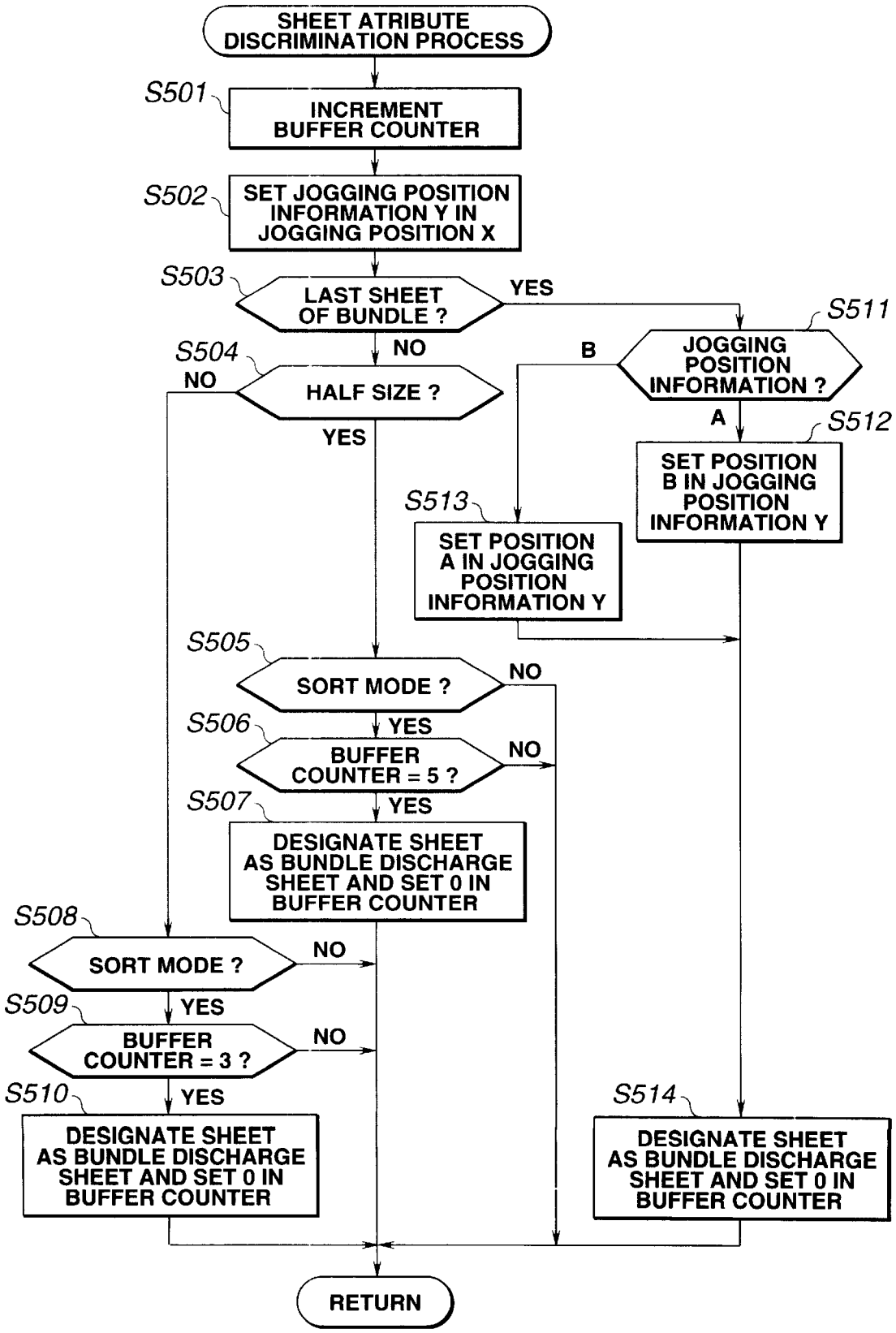
FIG. 11 shows a flowchart of a sheet attribute discrimination process in FIG. 10.

FIG. 11 shows a flowchart of the sheet attribute discrimination process. Finisher controller 501 increments a buffer counter (S501) and sets a jogging position information Y in the jogging position X (S502). The jogging position information Y is either at position A or B. Thereby, the sheet is jogged at the jogging position X at step S407 as described above. Then, finisher controller 501 discriminates if the sheet is the last sheet of a bundle (S503). The bundle means a unit for sorting the sheets in the sort mode and means a unit for stapling the sheets in the staple mode. If the sheet is not the last sheet of the bundle, finisher controller 501 discriminates if the sheet is a half size (A4 or B5) (S504). If the sheet is the half size, finisher controller 501 discriminates if the sort mode is designated (S505). If the sort mode is designated, that is, the staple mode is designated, finisher controller 501 returns to the sort sheet sequence.

If the sort mode is designated in step S505, finisher controller 501 discriminates if the buffer counter is 5 (S506). If the buffer counter is 5, finisher controller 501 designates the sheet as a bundle discharge sheet and sets 0 in the buffer counter (S507). By designating the sheet as the bundle discharge sheet, the bundle of sheets is discharged from process tray 630 to discharge tray 700 after the sheet is discharged onto process tray 630. If the buffer counter is not 5 at step S506, finisher controller 501 returns to the sort sheet sequence.

If the sheet is not the half size at step S504, finisher controller discriminates if the sort mode is designated (S508). If the sort mode is not designated, finisher controller returns to the sort sheet sequence.

If the sort mode is designated at step S508, finisher controller 501 discriminates if the buffer counter is 3 (S509). If the buffer counter is 3, finisher controller 501 designates the sheet as the bundle discharge sheet and sets 0 in the buffer counter (S510) and returns to the sort sheet sequence. If the buffer counter is not 3 at step S509, finisher controller 501 returns to the sort sheet sequence.

If the sheet is the last sheet of the bundle at step S503, finisher controller 501 discriminates the jogging position information Y (S511). If the jogging position information Y is the position A, finisher controller 501 sets the position B in the jogging position information Y (S512). If the jogging position information Y is the position B, finisher controller 501 sets the position A in the jogging position information Y (S513). Then, finisher controller 501 designates the sheet as the bundle discharge sheet and sets 0 in the buffer counter (S514) and returns to the sort sheet sequence.

Figure 12:
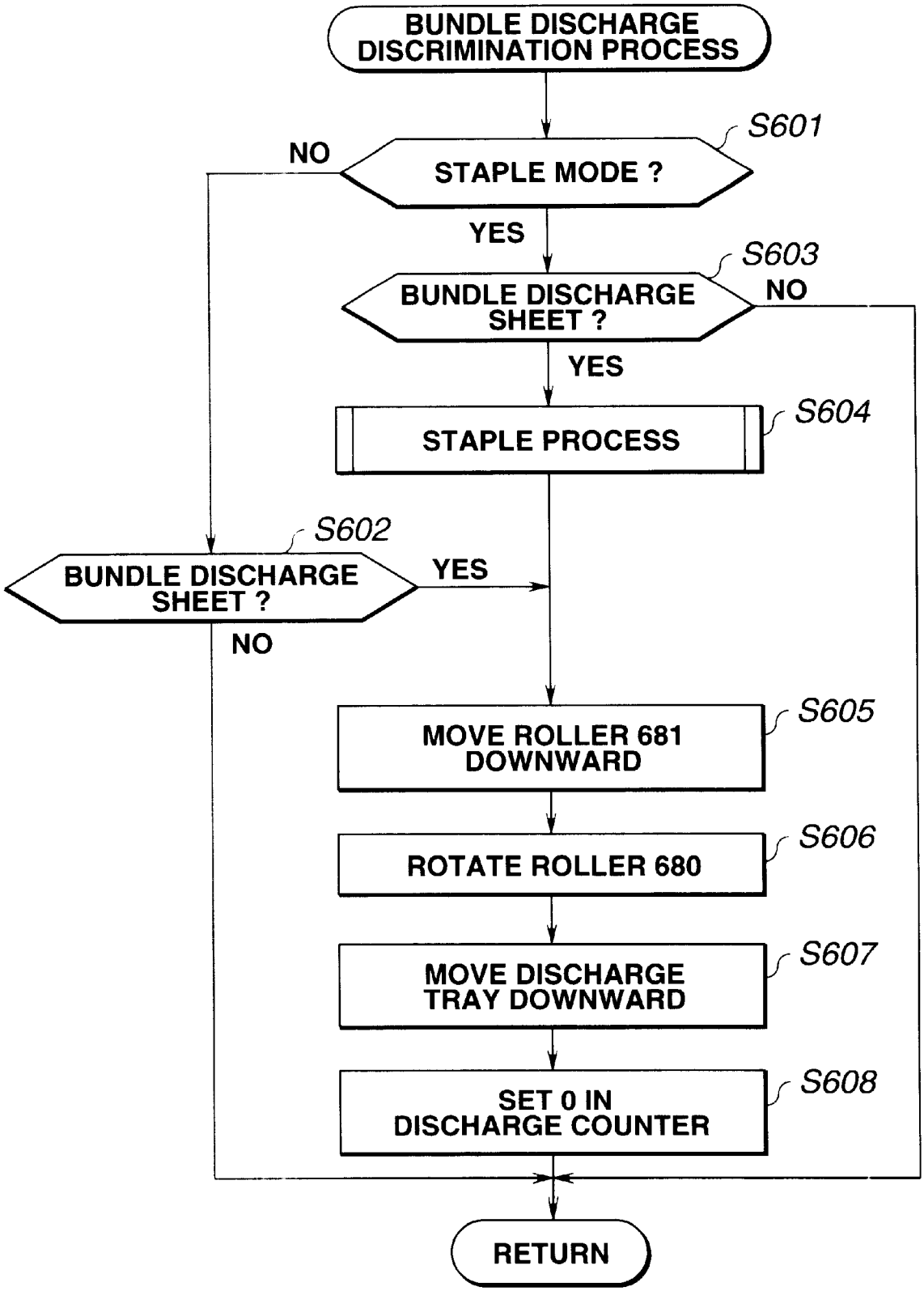
FIG. 12 shows a flow chart of a bundle discharge discrimination process in FIG. 10.

FIG. 12 shows a flow chart of the bundle discharge discrimination process. Finisher controller 501 discriminates if the staple mode is designated (S601). If the staple mode is not designated, finisher controller 501 discriminates if the sheet is designated as the bundle discharge sheet (S602). If the sheet is not designated as the bundle discharge sheet, finisher controller 501 returns to the sort sheet sequence. If the sheet is designated as the bundle discharge sheet, finisher controller 501 controls stapler 601 to staple the sheets on process tray 630 (S604) and controls movement of roller 681 downward (S605) and controls rotation of roller 680 in order to discharge the bundle of the sheets on process tray 630 to discharge tray 700 (S606). Then, finisher controller 501 controls discharge tray 700 to move downward for a distance according to the thickness of the bundle of the sheets (S607). Finisher controller 501 sets 0 in the discharge counter (S608) and returns to the sort sheet sequence.

Figure 13:
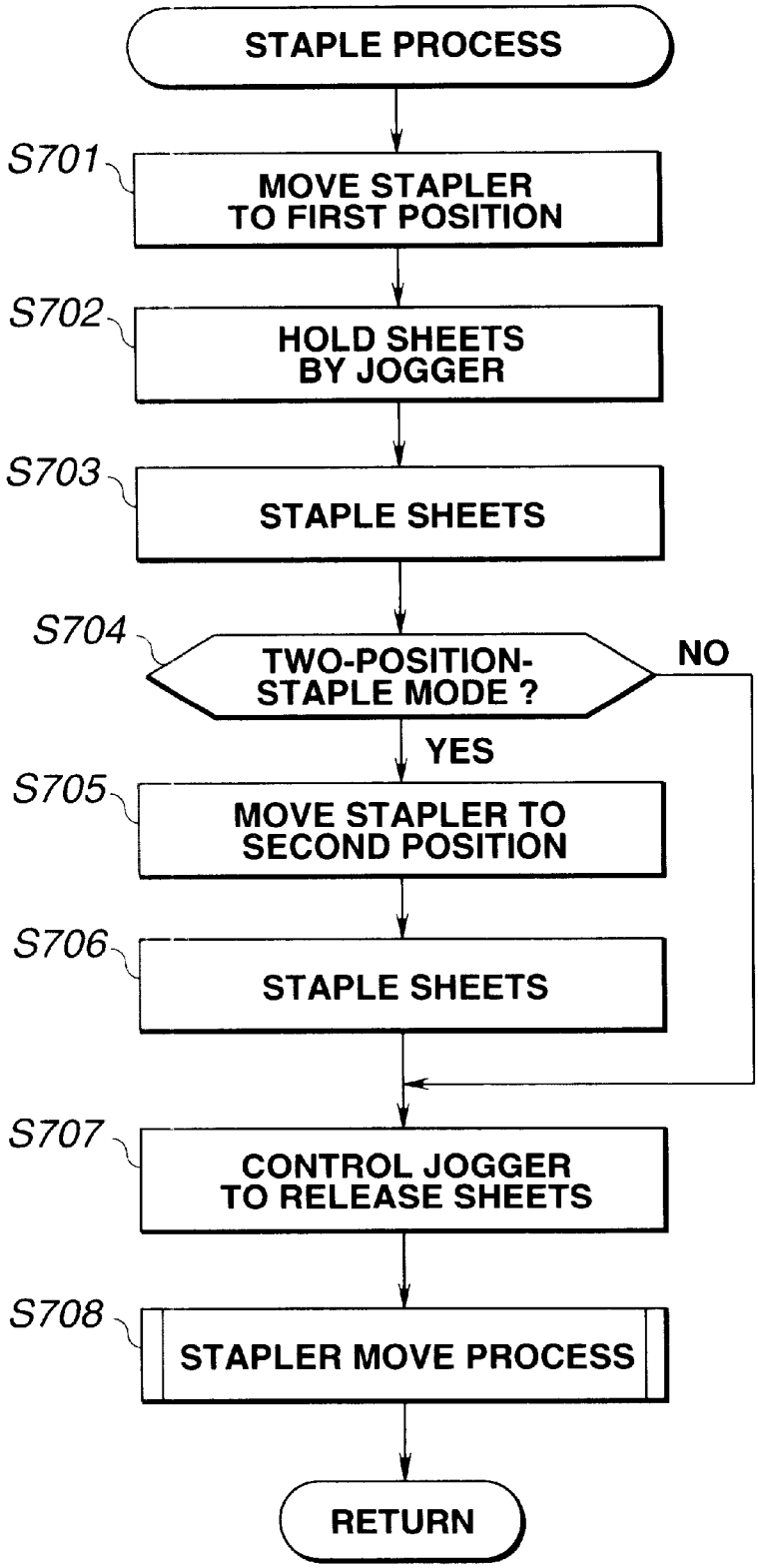
FIG. 13 shows a flowchart of a staple process in FIG. 12.
Figure 14:
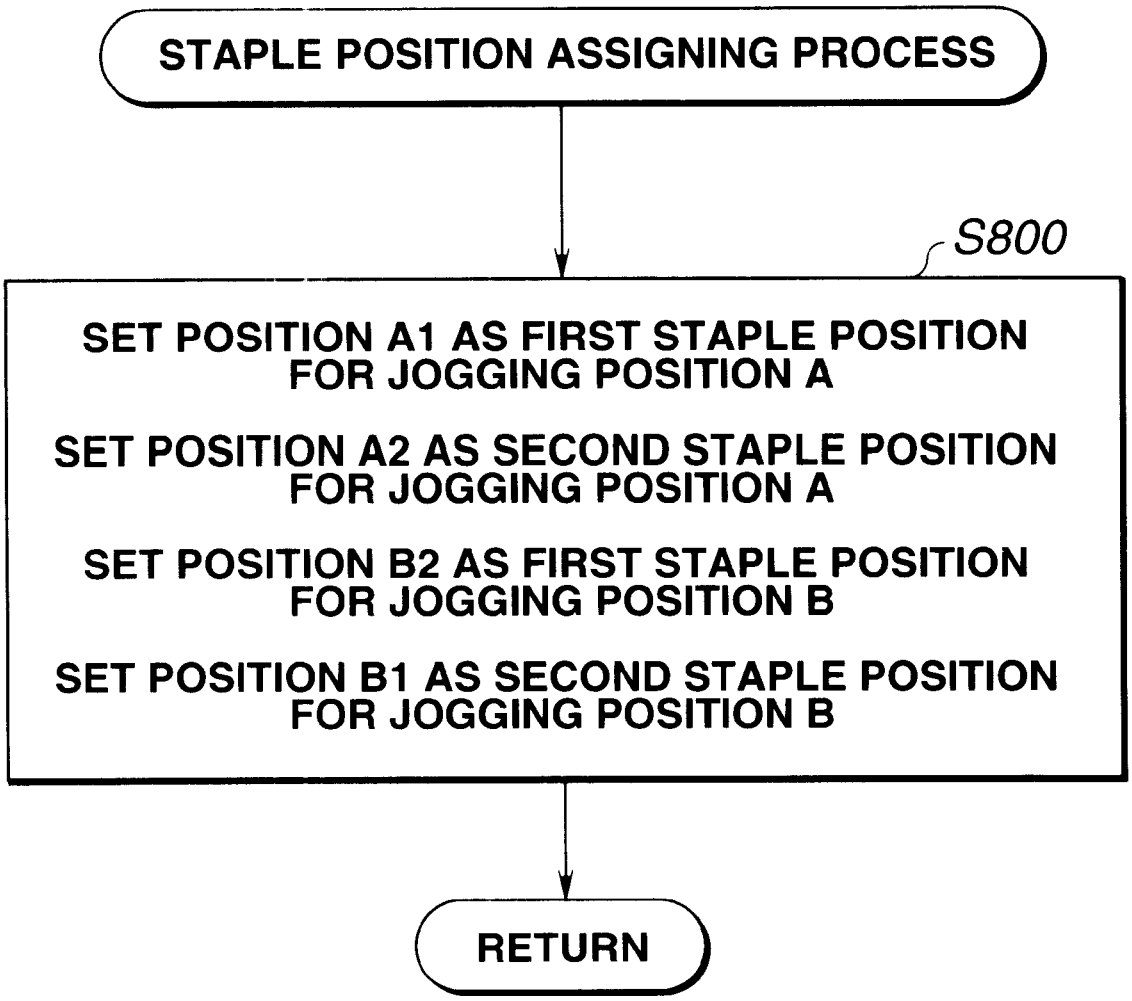
FIG. 14 shows a flowchart of a staple position designation process.
Figure 15:
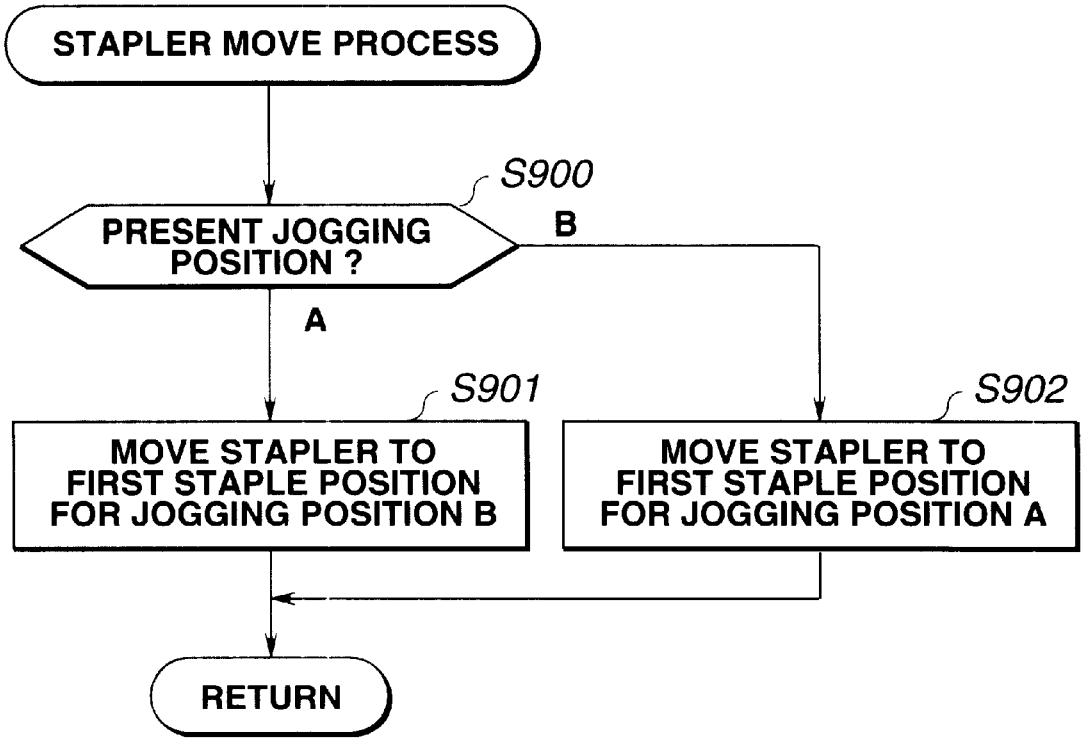
FIG. 15 shows a flowchart of a stapler move process in FIG. 13.
Figures 16A, 16B, 16C:
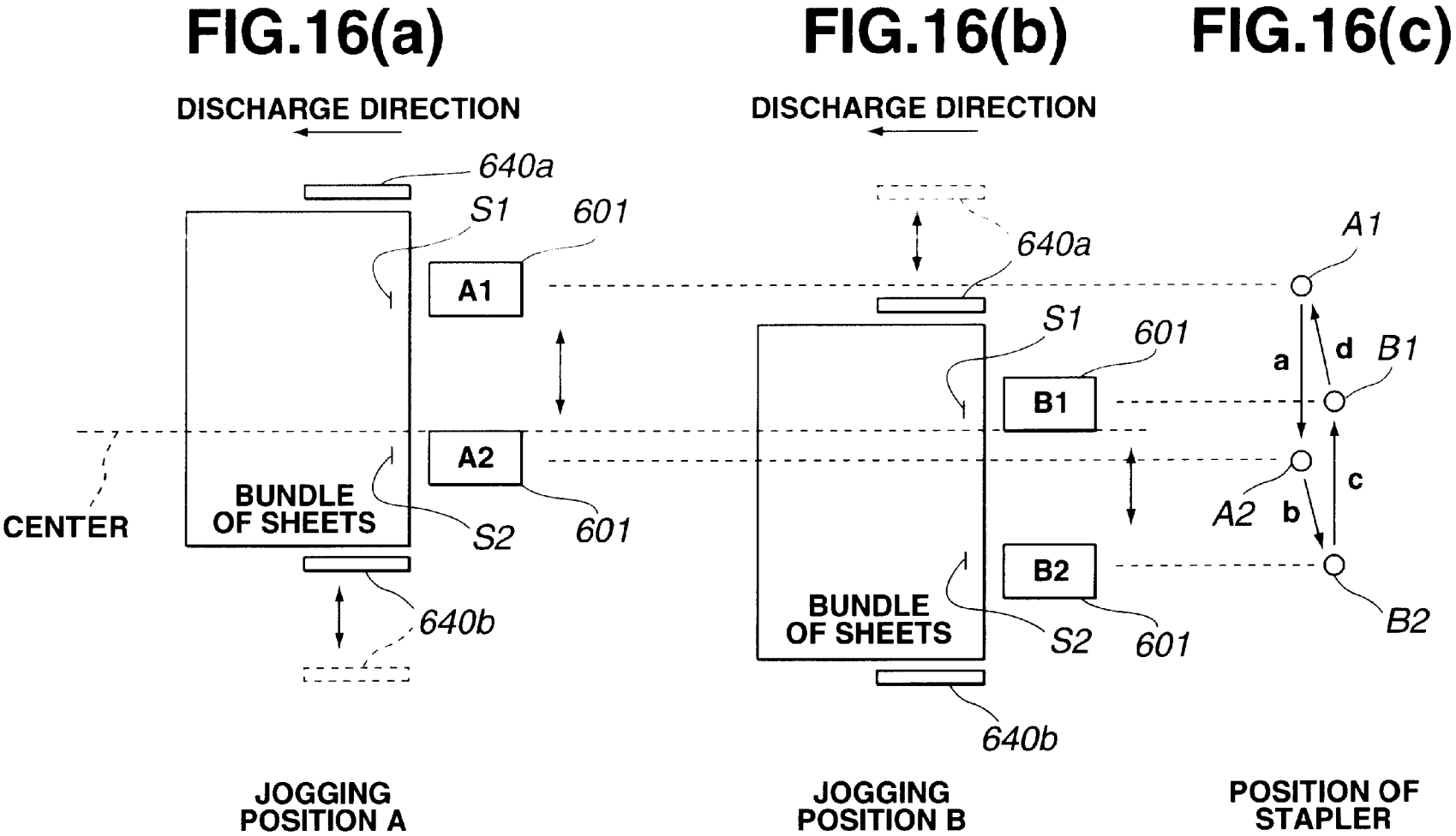
FIG. 16 shows a top plan view of a process tray.

The jogging process and stapling process will be described hereinafter with reference to FIGS. 13 to 16. FIG. 13 shows a flowchart of the staple process at step S604. FIG. 14 shows a flowchart of a staple position designation process. FIG. 15 shows a flowchart of a staple move process at step S708. FIG. 16 shows a top plan view of process tray 630 for showing positions of stapler 601 and jogger 640.

Jogger 640 includes joggers 640*a* and 640*b* which jog a sheet at either the position A or B as shown in FIG. 16. Joggers 640*a* and 640*b* are opposed and are movable in the direction perpendicular to the sheet discharge direction. In case where jogger 640 jogs the sheet at the position A, jogger 640*a* is positioned at the position shown in FIG. 16(*a*). Jogger 640*b* is positioned at the position drawn by a broken line before the sheet is discharged onto process tray 630. Jogger 640*b* is moved to the position drawn in a solid line on the right after the sheet is discharged onto process tray 630, thereby, the sheet is jogged to position A. In case where jogger 640 jogs the sheet at position B, jogger 640*b* is positioned at the position shown in FIG. 16(*b*). Jogger 640*a* is positioned at the position drawn by a broken line before the sheet is discharged onto process tray 630. Jogger 640*a* is moved to the position drawn in a solid line on the right after the sheet is discharged onto process tray 630, thereby, the sheet is jogged to position B.

As described above, the bundles of sheets are shifted with respect to each other and are sorted by jogging the sheet to either position A or B, alternating each bundle instead of shifting discharge tray 700 for each bundle.

In case where the sheet is stapled at two positions, stapler 601 is moved to a position corresponding to position A or B and staples the sheet as shown in FIG. 16. Specifically, when the sheet is jogged to position A, finisher controller 501 controls stapler 601 to move to position A1 corresponding to staple position S1 and controls stapler 601 to staple the sheet as shown in FIG. 16(*a*). Then, finisher controller 501 controls stapler 601 to move to position A2 corresponding to staple position S2 and controls stapler 601 to staple the sheet.

After the sheets jogged at position A are discharged to discharge tray, the next transported sheet is jogged at position B. When the sheet is jogged at the position B, finisher controller 501 controls stapler 601 to move to position B2 corresponding to staple position S2 and controls stapler 601 to staple the sheet. Then, finisher controller 501 controls stapler 601 to move to position B1 corresponding to staple position S1 and controls stapler 601 to staple the sheet. After the stapling at position B1, finisher controller controls stapler 601 to move to position A1. Stapler 601 is moved in the order of A1, A2, B2, and B1 in order to move stapler 601 in the short time as shown in FIG. 16(*c*).

FIG. 14 shows a flowchart of the staple position assigning process executed at step S3. Finisher controller 501 sets position A1 as first staple position for jogging position A and sets position A2 as second staple position for jogging position A and sets position B2 as first staple position for jogging position B and sets position B1 as second staple position for jogging position B (S800). That is, positions A1, A2, B1, and B2 are designated as shown in FIG. 16.

FIG. 13 shows a flowchart of the staple process. Finisher controller 501 controls stapler 601 to move to a (first) position corresponding to a jogging position in accordance with the designation at step S800 (S701). Finisher controller 501 controls jogger 640 to hold the sheets on process tray 630 (S702) and controls stapler 601 to staple the sheets (S703). Then, finisher controller 501 discriminates if the two positions staple mode is designated (S704). If the two-position-staple mode is designated, finisher controller 501 controls stapler 601 to move to a second position in accordance with the designation at step S800 (S705) and controls stapler 601 to staple the sheets (S706).

Finisher controller 501 controls jogger 640*a* or 640*b* to release the sheets on process tray 630 (S707) and executes a staple move process (S708) and thereafter returns to the bundle discharge discriminate process. The stapler move process will be described later.

If the two-position-staple mode is not designated at step S704, that is, if a one position staple mode is designated, finisher controller 501 advances to step S707.

FIG. 15 shows a flowchart of the staple move process in the two-position-staple mode. Finisher controller 501 discriminates a present jogging position (S900). If the present jogging position is position A, finisher controller 501 controls stapler 601 to move to the first staple position for the jogging position B (position B2 in FIG. 16) (S901) and returns to the staple mode. If the present jogging position is position B, finisher controller 501 controls to move stapler 601 to the first position for the jogging position A (position A1 in FIG. 16) (S902) and returns to the staple mode.

It is to be understood that the phraseology or terminology employed herein in for the purpose of description and not of limitation.

What is claimed is:

1. Sheet processing apparatus comprising:

a first tray for stacking sheets received from an image forming apparatus;

a jogger for jogging the sheet stacked on said first tray at a jogging position of a plurality of jogging positions;

a discharger for discharging the sheet stacked on said first tray; and a second tray for stacking the sheets discharged by said discharger;

a binder for binding the sheets stacked on said first tray, said binder being movable; and a controller for controlling said binder to move to a position corresponding to the jogging position by said jogger and controlling said binder to bind the sheets on said first tray.

2. Sheet processing apparatus according to claim 1, wherein said binder includes a stapler for stapling the sheets stacked on said first tray, said controller controls said stapler to move to a position corresponding to the jogging position by said jogger and controls said stapler to staple the sheets on said first tray.

3. Sheet processing apparatus according to claim 2, wherein said controller controls said stapler to staple at least two positions on the sheets.

4. Sheet processing apparatus according to claim 3, wherein said controller controls said stapler to move in either a first direction or a second direction alternately for each bundle of sheets when said stapler staples at least two positions on the sheets.

5. sheet processing apparatus according to claim 1, wherein a distance between the jogging position and the binding position corresponding to the jogging position is constant regardless of the jogging position.

6. Sheet processing apparatus according to claim 5, wherein said controller controls said binder to move to the binding position.

7. Sheet processing apparatus according to claim 1, wherein said jogger changes the jogging position alternately for each bundle of sheets.

8. Sheet processing apparatus according to claim 1, wherein said jogger includes at least two jogging members which moves in a direction perpendicular to a discharge direction by said discharger.

9. Sheet processing apparatus according to claim 1, wherein said controller controls said binder to bind at a same binding position on the sheets regardless of the jogging position.

10. Sheet processing apparatus according to claim 1, wherein said binder moves along a direction perpendicular to a discharge direction of said discharger.

11. Sheet processing apparatus according to claim 4, wherein said controller controls said stapler to move to a first position and a second position when said stapler moves in the first direction and controls said stapler to move to a third position and a fourth position when said stapler moves in the second direction.

12. A sheet processing method comprising the steps of:

stacking sheets received from an image forming apparatus on a first tray;

jogging the sheets stacked on the first tray at a jogging position of a plurality of jogging positions;

discharging the sheets stacked on the first tray;

stacking the sheets discharged by the discharger on a second tray;

binding the sheets stacked on the first tray with a movable binder; and controlling the movable binder to move to a position corresponding to the jogging position and controlling the movable binder to bind the sheets on the first tray.

13. A sheet processing method according to claim 12, wherein the binding step includes stapling the sheets stacked on the first tray, and the stapler is controlled to move to the position corresponding to the jogging position to staple the sheets on the first tray.

14. A sheet processing method according to claim 13, wherein the stapler is controlled to staple at least two positions on the sheets.

15. A sheet processing method according to claim 14, wherein the stapler is controlled to move in either a first direction or a second direction alternately for each bundle of sheets when the stapler staples at least two positions on the sheets.

16. A sheet processing method according to claim 12, wherein a distance between the jogging position and the binding position corresponding to the jogging position is constant regardless of the jogging position.

17. A sheet processing method according to claim 16, wherein the binder is controlled to move to the binding position.

18. A sheet processing method according to claim 12, wherein the jogging position is changed alternately for each bundle of sheets.

19. A sheet processing method according to claim 12, wherein the jogging step is with at least two jogging members which move in a direction perpendicular to a discharge direction by the discharger.

20. A sheet processing method according to claim 12, wherein the binder is controlled to bind at a same binding position on the sheets regardless of the jogging position.

21. A sheet processing method according to claim 12, wherein the binder moves along a direction perpendicular to a discharge direction of said discharger.

22. A sheet processing method according to claim 15, wherein the stapler is controlled to move to a first position and a second position when the stapler moves in the first direction and is controlled to move to a third position and a fourth position when the stapler moves in the second direction.

23. A recording medium on which is stored machine readable code for performing a sheet processing method, the code performing the steps of:

stacking sheets received from an image forming apparatus on a first tray;

jogging the sheets stacked on the first tray at a jogging position of a plurality of jogging positions;

discharging the sheets stacked on the first tray;

stacking the sheets discharged by the discharger on a second tray;

binding the sheets stacked on the first tray with a movable binder; and controlling the movable binder to move to a position corresponding to the jogging position and controlling the movable binder to bind the sheets on the first tray.

24. A recording medium according to claim 23, wherein the binding step includes stapling the sheets stacked on the first tray, and the stapler is controlled to move to the position corresponding to the jogging position to staple the sheets on said first tray.

25. A recording medium according to claim 24, wherein the stapler is controlled to staple at least two positions on the sheets.

26. A recording medium according to claim 25, wherein the stapler is controlled to move in either a first direction or a second direction alternately for each bundle of sheets when the stapler staples at least two positions on the sheets.

27. A recording medium according to claim 23, wherein a distance between the jogging position and the binding position corresponding to the jogging position is constant regardless of the jogging position.

28. A recording medium according to claim 27, wherein the binder is controlled to move to the binding position.

29. A recording medium according to claim 23, wherein the jogging position is changed alternately for each bundle of sheets.

30. A recording medium according to claim 23, wherein the jogging step is with at least two jogging members which move in a direction perpendicular to a discharge direction by said discharger.

31. A recording medium according to claim 23, wherein the binder is controlled to bind at a same binding position on the sheets regardless of the jogging position.

32. A recording medium according to claim 23, wherein the binder moves along a direction perpendicular to a discharge direction of said discharger.

33. A recording medium according to claim 26, wherein the stapler is controlled to move to a first position and a second position when the stapler moves in the first direction and is controlled to move to a third position and a fourth position when the stapler moves in the second direction.

34. Sheet processing apparatus according to claim 11, wherein the second position is closer to the third position than to the fourth position.

35. A sheet processing method according to claim 22, wherein the second position is closer to the third position than to the fourth position.

36. A recording medium according to claim 35, wherein the second position is closer tot he third position than to the fourth position.

* * * * *

UNITED STATES PATENT AND TRADEMARK OFFICE

CERTIFICATE OF CORRECTION

PATENT NO. : 6,371,472 B1
DATED : April 16, 2002
INVENTOR(S) : Norifumi Miyake et al.

It is certified that error appears in the above-identified patent and that said Letters Patent is hereby corrected as shown below:

Column 1,
Line 12, "staples" should read -- staple --.
Line 35, "rise" should read -- raise --.

Column 4,
Line 43, "includes" should read -- include --.

Column 7,
Line 29, "transports" should read -- transport --.

Column 9,
Line 66, "in" should read -- is --.

Column 10,
Line 30, "sheet" should read -- Sheet --.
Line 42, "moves" should read -- move --.

Column 12,
Line 49, "tot he" should read -- to the --.

Signed and Sealed this

Twentieth Day of August, 2002

*Attest:*

*Attesting Officer*

JAMES E. ROGAN
*Director of the United States Patent and Trademark Office*